US006244184B1

(12) United States Patent
Tadmor

(10) Patent No.: US 6,244,184 B1
(45) Date of Patent: Jun. 12, 2001

(54) FUZE FOR SUBMUNITION GRENADE

(75) Inventor: Oded Tadmor, Ramat Hasharon (IL)

(73) Assignee: Israel Military Industries Ltd., Ramat Hasharon (IL)

( * ) Notice: Subject to any disclaimer, the term of this patent is extended or adjusted under 35 U.S.C. 154(b) by 0 days.

(21) Appl. No.: 09/108,259

(22) Filed: Jul. 1, 1998

(30) Foreign Application Priority Data

Jul. 30, 1997 (IL) ..... 121428

(51) Int. Cl.[7] ..... F42C 15/44
(52) U.S. Cl. ..... 102/266; 102/499
(58) Field of Search ..... 102/499, 500, 102/265, 266

(56) References Cited

U.S. PATENT DOCUMENTS

| | | | | |
|---|---|---|---|---|
| 2,775,942 | * | 1/1957 | Dell et al. . | |
| 3,504,632 | * | 4/1970 | West et al. . | |
| 3,570,404 | * | 3/1971 | Pope | 102/70.2 |
| 3,633,510 | * | 1/1972 | Bernardin | 102/74 |
| 3,759,183 | * | 9/1973 | Apstein . | |
| 3,765,339 | * | 10/1973 | De Angelis et al. | 102/78 |
| 3,983,819 | * | 10/1976 | Fairbanks et al. | 102/70.2 |
| 4,212,246 | * | 7/1980 | Eaton . | |
| 4,230,042 | | 10/1980 | Popovitch | 102/233 |
| 4,239,005 | * | 12/1980 | Simmons | 102/28 R |
| 4,320,704 | | 3/1982 | Gawlick et al. | 102/218 |
| 4,998,476 | | 3/1991 | Rüdenauer et al. | 102/226 |
| 5,189,770 | * | 3/1993 | Waidhas et al. | 29/25.03 |
| 5,263,416 | * | 11/1993 | Amundson et al. | 102/202.9 |
| 5,373,790 | * | 12/1994 | Chemiere | 102/226 |
| 5,375,526 | | 12/1994 | Hoffmann | 102/269 |
| 5,387,257 | | 2/1995 | Tari et al. | 102/226 |
| 5,576,510 | | 11/1996 | Rudenauer | 102/231 |
| 5,585,591 | * | 12/1996 | Stearns et al. | 102/233 |
| 5,585,592 | * | 12/1996 | Stearns et al. | 102/233 |

FOREIGN PATENT DOCUMENTS

| | | | | |
|---|---|---|---|---|
| 3706819 A1 | | 9/1988 | (DE) . | |
| 4116224 A1 | | 11/1992 | (DE) . | |
| 605356 A1 | * | 7/1994 | (EP) | 102/265 |
| 2691795 | | 12/1993 | (FR) . | |
| 1533971 | * | 11/1978 | (GB) | 102/265 |
| 2064074 | * | 6/1981 | (GB) | 102/265 |
| 2134229 | * | 8/1984 | (GB) | 102/265 |
| 2259971 | | 3/1993 | (GB) . | |
| WO 87/01193 | | 2/1987 | (WO) . | |

* cited by examiner

*Primary Examiner*—Charles T. Jordan
*Assistant Examiner*—Kevin Jakel
(74) *Attorney, Agent, or Firm*—Wolf, Greenfield & Sacks, P.C.

(57) ABSTRACT

A fuze for a submunition grenade including an electric detonator and primary super quick apparatus for electrically initiating the electric detonator upon percussion. Preferably, the fuze also includes self-destruct apparatus for electrically initiating said electric detonator, after a period of time, when said primary apparatus fails to initiate said electric detonator.

14 Claims, 6 Drawing Sheets

| |
|---|
| FIG. 6A |
| FIG. 6B |

FUZE FOR SUBMUNITION GRENADE

FIELD OF THE INVENTION

The present invention relates to fuzes in general and, in particular, to self-destruct fuzes for submunitions.

BACKGROUND OF THE INVENTION

In recent years there has been great development of smart munitions, including cluster bombs which fire a plurality of submunitions or submunition grenades inside a single casing which opens over the target to release the submunitions within, and their increasing use around the world against a variety of targets. However, conventional submunition grenades have a number of disadvantages. The use of submunition grenades having a shaped charge and a simple inertial impact fuze is effective against armoured targets, but is is limited in its efficacy against area targets.

Conventional submunition grenades also suffer from undesirable initiation of fuzes due to collisions in air by submunition grenades, i.e., immediately after their expulsion. This lowers the reliability of the system, leads to loss of the submunition grenade, damages neighboring submunition grenades by the explosion, and creates duds.

Furthermore, the increasing use of submunition grenades creates a large quantity of duds which endanger friendly forces. These duds can be used by the enemy as booby traps, and call for substantial resources to clean the affected area, in order to permit its use by civilians. In addition, the heavy metals and other materials found in the batteries of many of the conventional submunition grenades' fuzes damages the ecology of the area in which they fall.

One solution to this problem is provided by Tari et al, in U.S. Pat. No. 5,387,257 which describes a self-destruct fuze for submunition grenades. The fuze includes an electrical self-destruct unit which is operative in the event that the mechanical primary inertial impact mode fails to operate upon striking an intended target. This fuze includes all the components for a conventional impact fuze, as well as an entirely separate electric self-destruct system. The fuze is relatively large, to accomodate the mechanical impact detonator and the battery. The fuze is problematic for several reasons: the batteries include heavy metals and other materials which damage the environment; the chemicals in the batteries age, but the batteries cannot be replaced since it is difficult to reach them in each grenade; the fuze includes a mechanical striker which, in the case of a dud, can be activated accidentally by friendly forces, or can be used to initiate the submunition grenade as a booby trap; the reserve battery in the fuze can be activated by transportation vibration, whereby there will be no electricity to initiate the detonator at the time of firing the submunition grenade in the case of a dud.

SUMMARY OF THE INVENTION

According to the present invention, there is provided a fuze for a submunition grenade which includes an electric detonator, primary apparatus for electrically initiating the electric detonator, and self-destruct apparatus for electrically initiating the electric detonator, after a period of time, when the primary apparatus fails to detonate the detonator. Preferably, the fuze has no internal energy source, but only a capacitor which is charged by an external energy source.

According to a preferred embodiment of the invention, the submunition grenade includes an electric detonator, and the primary apparatus includes an integrated circuit, an impact switch coupled to the integrated circuit, and an electric resistor bridge coupled to the electric detonator and to the integrated circuit for initiating the electric detonator in response to activation of the impact switch.

Further according to a preferred embodiment, the self-destruct apparatus includes a timer, and an integrated circuit for initiating the electric detonator after passage of a predetermined time in response to activation by the timer.

There is also provided in accordance with the present invention a method of initiating a submunition grenade having a fuze and an electric detonator, the submunition grenade being arranged to be ejected from a projectile, the method including the steps of releasing the submunition grenade from the projectile, electronically counting an inhibition time, and electrically initiating an electric detonator by a primary initiator.

According to a preferred embodiment of the invention, if the primary initiation does not cause the detonator to explode, the method further includes the steps of electronically counting time to self-destruct, and electrically initiating the electric detonator by means of a self-destruct initiator.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a self-destruct fuze for submunitions, such as submunition grenades, in which both the primary initiator and the self-destruct initiator are electrical initiators of an electric detonator. The fuze includes a primary mode of super quick (S.Q.) initiation upon impact, the possibility of initiation after a short delay after bouncing the submunition grenade from the ground into the air, and a self-destruct mode in case of arming failure or failure of the primary mode of initiation. The self-destruct initiation is arranged to occur a predetermined length of time after firing, which may be several minutes or several hours, or self-neutralization of the detonator in an unarmed fuze in a super quick mode by percussion.

It is a particular feature of the present invention that the initiation in both the primary mode and the self-destruct mode are electrical, with no mechanical initiation of a percussion detonator upon impact, resulting in a significantly simpler and lighter yet highly reliable fuze mechanism. It is a further particular feature that, in the case of a dud, there is no striker so the fuze cannot be initiated.

Figure 1:
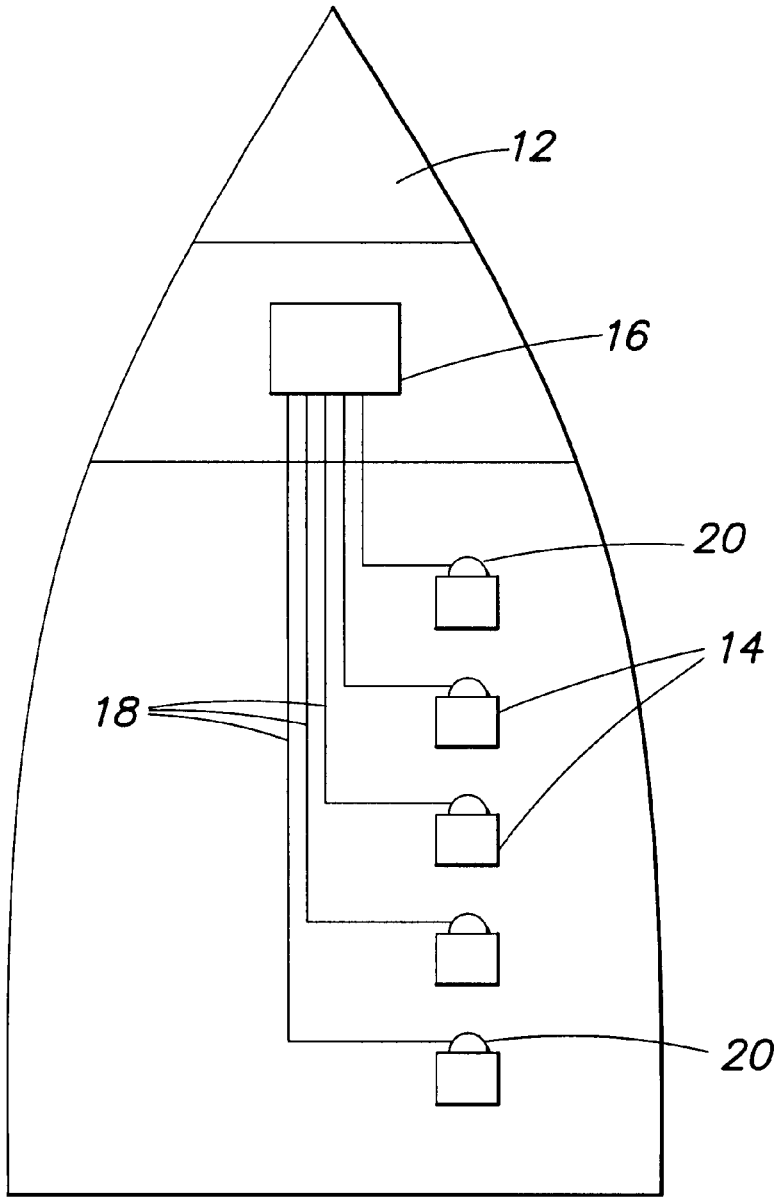
FIG. 1 is a schematic side sectional view of a projectile carrying a plurality of submunitions, each having an electronic fuze according to the present invention.

Referring now to FIG. 1, there is shown a schematic side sectional view of a projectile 10 having its own conventional fuze 12, and carrying a plurality of submunition granades (also known as bomblets) 14, each having an electronic fuze 20 according to the present invention. Projectile 10 can be any conventional projectile for carrying a plurality of submunitions, including a shell, mortar bomb, air cluster bomb, or rocket. Mounted in the head of projectile 10 is a battery 16 coupled to each fuze 20 by means of conductors 18. Battery 16 can be any suitable battery, whether a primary battery, a reserve battery, or a thermal battery. A thermal battery is preferred, such as battery number SAP-12116 of Eagle Picher Industries, Inc, USA.

It is a particular feature of the illustrated embodiment that the battery (or other active energy source) is separate from the fuze, and not internal. While this configuration is preferred, due to ease of replacement of the single battery when required, it will be appreciated that, alternatively, separate batteries can be provided for each layer or column of submunitions 14 inside the projectile. Both these options are preferred due to the small number of batteries relative to the number of submunition grenades, and the low weight of the resulting fuze. Alternatively, a separate battery can be provided in each fuze.

Figure 2:
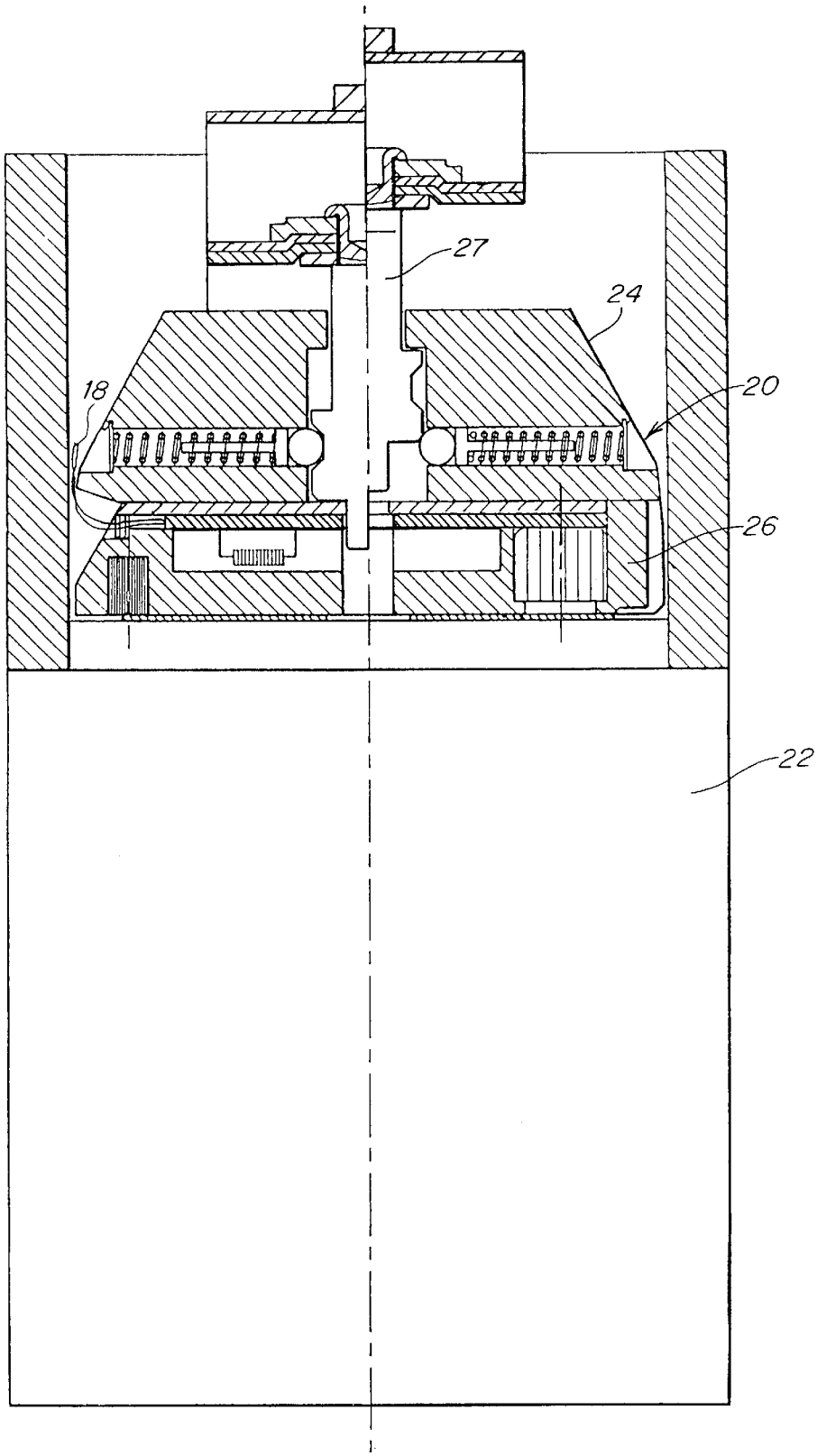
FIG. 2 is a split side sectional view of a submunition grenade fuze constructed and operative in accordance with one embodiment of the invention.

Referring now to FIG. 2, there is shown a side sectional view of an electronic fuze 20 constructed and operative in accordance with one embodiment of the present invention. Electronic fuze 20 is installed in the upper part of a submunition grenade 22. Fuze 20 includes a fuze body 24. Mounted in fuze body 24 is a slider 26, shown in detail in FIG. 3, and a slider locking pin 27.

Figure 3:
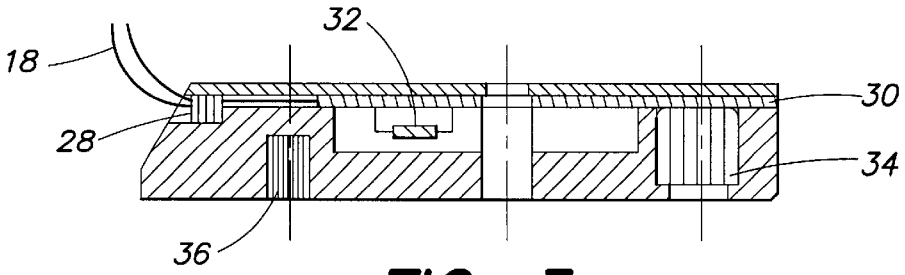
FIG. 3 is a side sectional view of a slider according to one embodiment of the invention for use in the fuze of the present invention.

FIG. 3 is a side sectional view of a slider 26 according to one embodiment of the invention, for use in the fuze of the present invention. Slider 26 includes an electric socket 28 to which are coupled conductors 18 from the battery, and an electronic card 30. Socket 28 is coupled to a capacitor 32 which serves to receive and store electrical energy to activate an electric detonator 34 and the electric circuit. A weight 36 may optionally be provided to ensure arming of the submunition grenade fuze by centrifugal force.

It is a particular feature of this embodiment of the invention that energy capacitors are used for the initiation of the electrical circuit in the submunition grenade fuzes, rather than mounting a separate battery in each fuze. The use of capacitors permits convenient replacement of the main battery for maintenance purposes. A thermal battery is preferred because it is not sensitive, and will not be activated by high level mechanical vibration.

Figure 4A:
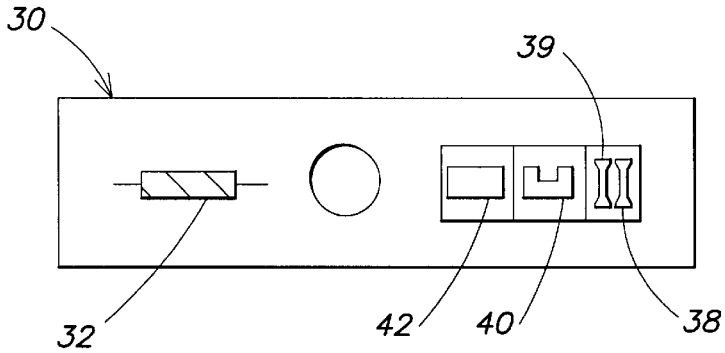
FIGS. 4*a* and 4*b* are respective plan and side views of the electronic card in the slider of FIG. 3.
Figure 4B:
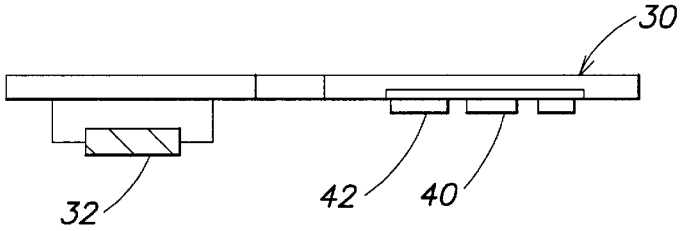

FIGS. 4*a* and 4*b* are respective plan and side views of the electronic card 30 in the slider of FIG. 3. As can be seen, electronic card 30 includes capacitor 32, two electric resistor bridges 38 and 39, an impact switch 40, such as an accelerometer, which can function as an accelerometer, and a digital integrated circuit (IC) 42. According to the illustrated embodiment, electric resistor bridges 38 and 39, impact switch 40 and IC 42 are formed by micromachining (MicroElectroMechanical System) as a single element, as seen in FIG. 4*b*. Alternatively, these elements can be mounted on electronic card 30 as individual elements, or any two of these elements as a hybrid element.

Figure 4C:
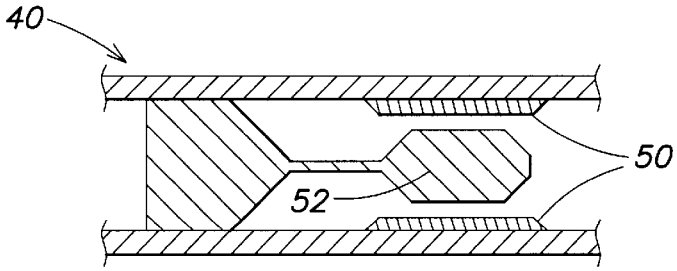
FIG. 4*c* is a detail illustration of an impact switch.

Electric resistor bridge 38 is the primary initiator for electric detonator 34. Bridge 38 is coupled to impact switch 40. FIG. 4*c* shows an example of an impact switch formed by micromachining. Impact switch 40 includes a fixed electrode 50 and a floating electrode 52. Electric resistor bridge 39 is the self-destruct initiator for actuating electric detonator 34, in the event that bridge 38 did not do so.

Figure 5:
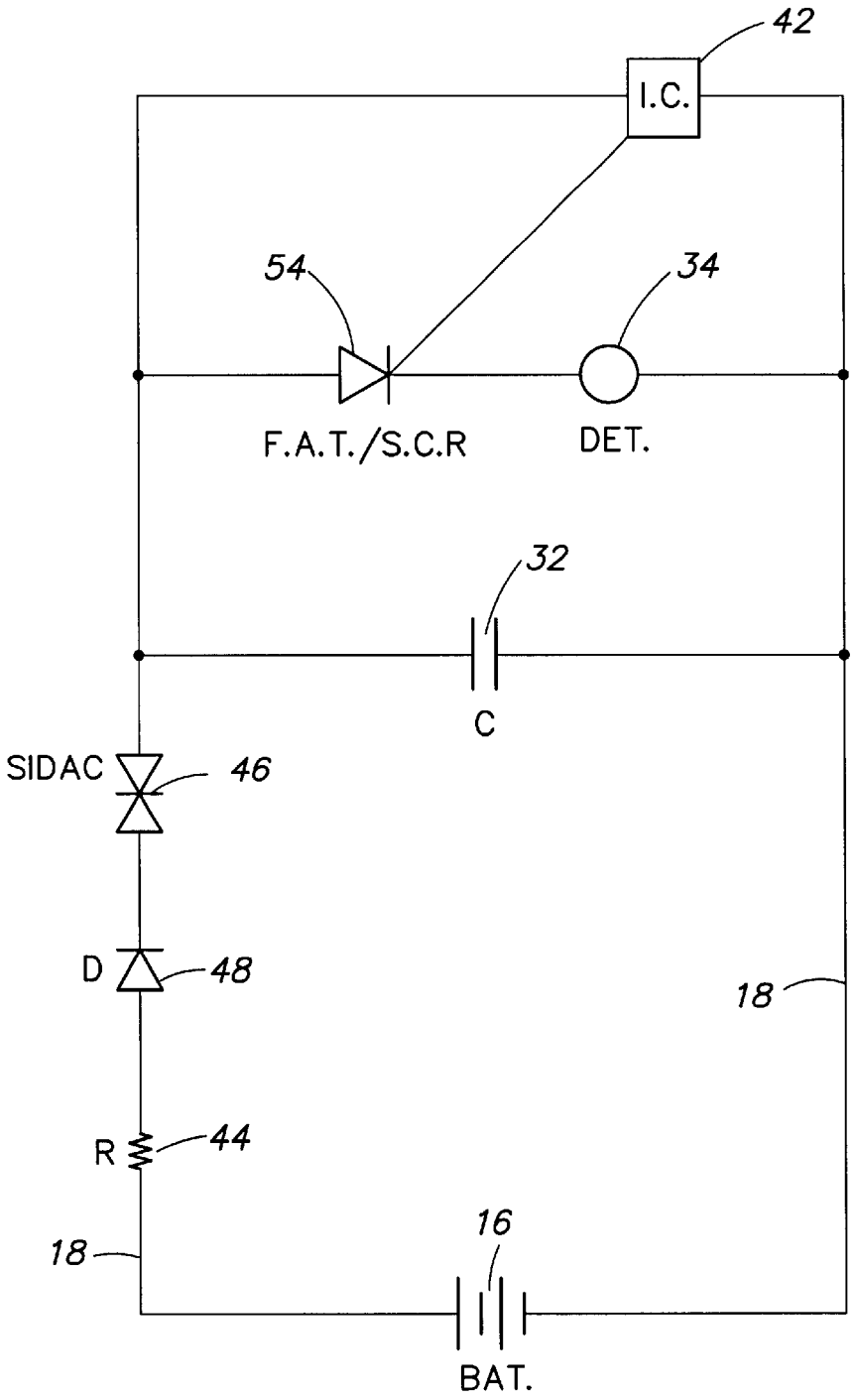
FIG. 5 is an electric circuit operative in the fuze of FIG. 2.

FIG. 5 shows an electric circuit operative in the fuze of FIG. 2. In the illustrated embodiment, the capacitor 32 of each fuze is charged through an electric resistor 44 that prevents a short circuit of the battery in case of a short circuit in the conductors 18 to one of the fuzes, which might lead to non-charging of the rest, and through a SIDAC 46 that prevents random charging of the capacitors, i.e., by an electrical field, which might cause an undesirable starting of the electrical circuitry in the fuze, by the prevention of an undesirable voltage passage, e.g., voltage below 30V. A diode 48 is also provided in order to prevent the discharge of the capacitor by an undesirable short circuit in conductors 18. For example, after the expulsion of the submunition grenades from the projectile, it is possible to have a short circuit in the conductors while they are being torn, or because of humidity at the impact site.

The electric circuit also includes a switching element 54 coupled to the integrated circuit 42. Switching element 54 can be any suitable element, such as F.A.T. or S.C.R. When the detonator is actuated by impact switch 40 or self-destruct timer in integrated circuit 42, IC 42 sends an order to switching element 54 to close the circuit between capacitor 32 and detonator 34, thereby causing one of electric resistor bridges 38 or 39 to initiate detonator 34.

Figure 6A:
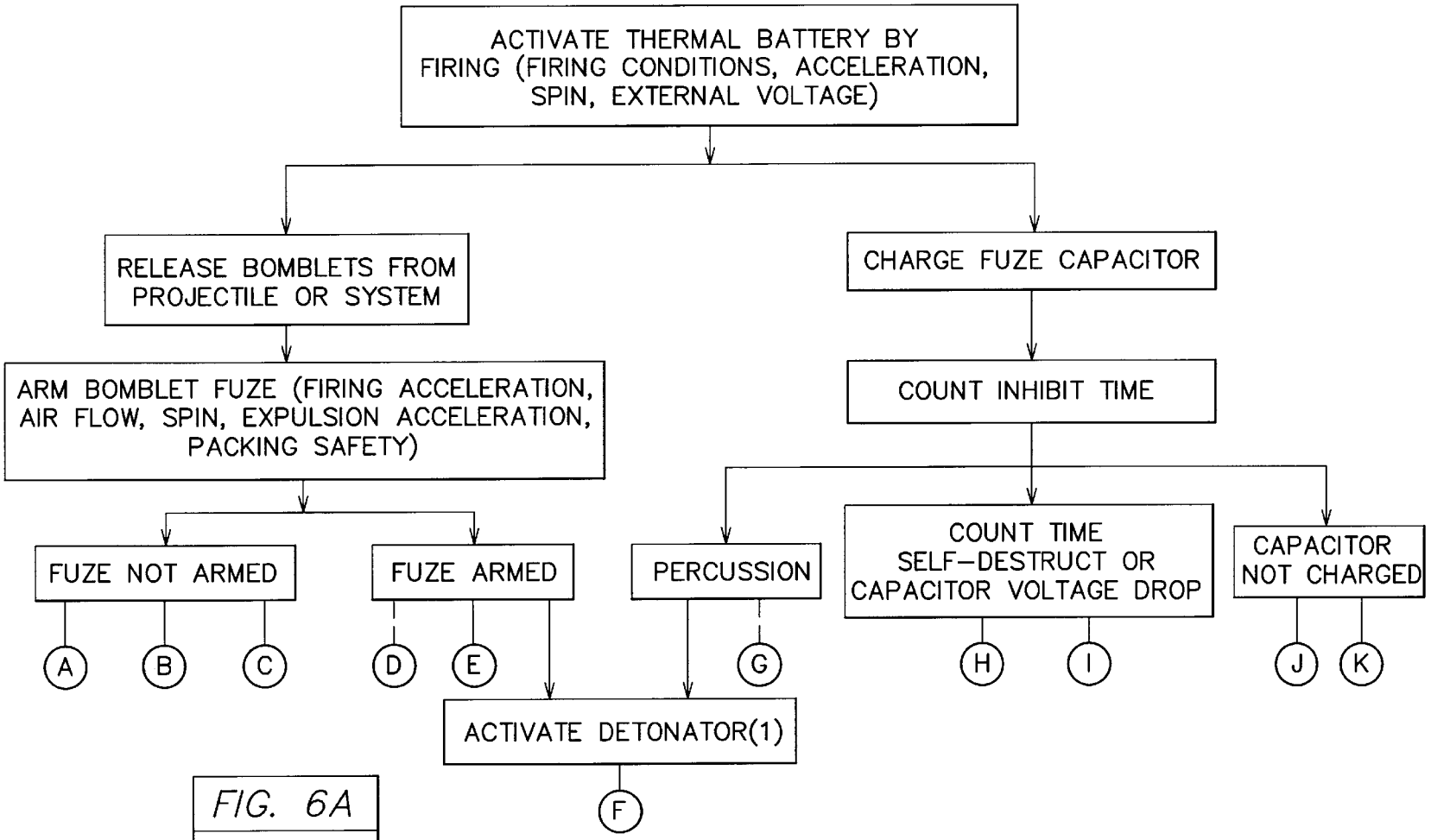
FIGS. 6A and 6B combined are a flow chart of the operation of the fuze of the present invention.
Figure 6B:
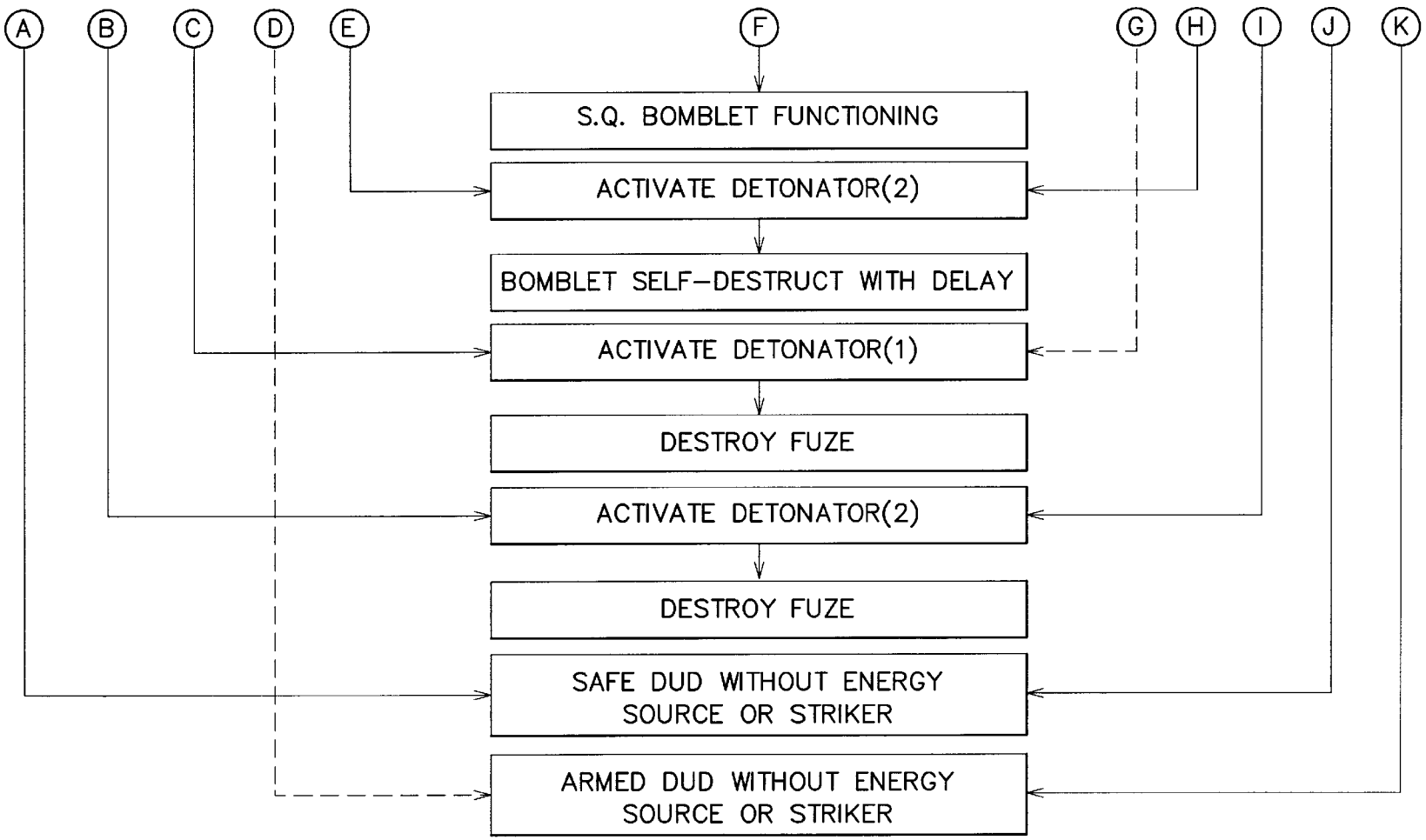

Referring now to FIG. 6 there is shown a flow chart of the operation of the fuze of the present invention. In general, operation of the fuze of the present invention is as follows, with further reference to FIGS. 1–5. After launching of projectile 10, battery 16 is connected or actuated by environmental conditions occurring during the normal launching process, i.e. acceleration, spin, aerodynamic deceleration, or external voltage, or any combination, and begins to supply electric energy. Battery 16 charges capacitors 32 located in sliders 26 via conductors 18.

When the projectile's fuze is actuated, the submunition grenades are released from the projectile and are then mechanically armed. The arming of the submunition grenades is done by the combination of conditions typical to launching or shooting: for example, release of a set back pin in a mortar bomb during shooting; extraction of the pin by a stabilizing ribbon in all of the systems; the release of a centrifugal pin in spinning systems, such as shells and artillery rockets. This brings the slider to the armed position by centrifugal forces in spinning systems, or by means of a spring in non-spinning ones.

After the fuze capacitors are charged from the battery, an electronic self-destruct time count starts (from about 4 minutes to several hours, as determined by the fuze configuration during production.) During ejection of the submunition grenades from the shell, the conductors 18 between the battery 16 and the fuzes 20 are torn. Then, by means of accelerometer 40, or by sensing the tearing of the conductors, the ejection of the submunition grenades is sensed and this triggers a short inhibition delay time of about 0.5 sec. by means of IC 42. During this time, even a strong impact will not actuate the fuze, thus preventing explosions due to collisions between submunition grenades or between submunition grenades and any system components.

The deceleration due to ground impact is measured by the accelerometer 40. It is possible to actuate the fuze immediately (S.Q.) upon sensing the impact, such as at high acceleration levels which occur while hitting a hard target, such as armoured targets, which is the most effective way to initiate shaped charges, while upon hitting a soft target, the fuze would actuate a pyrotechnic bouncing system for the submunition grenade and would actuate the main submunition grenade charge after a short delay of several tenths of a second, when the submunition grenade is at the optimal height against personnel targets.

For redundancy, two electrical resistor bridges 38 and 39 are provided, one actuated by impact, and the other by the self-destruct mode. If the fuze did not function upon impact, the self-destruct system is activated which destroys the fuze and the submunition grenade when the fuze has been armed. If the fuze has not been armed, only the electrical detonator is destroyed with either percussion (acting as a primary self-neutralization mode) or delay (acting as a secondary self-neutralization mode). In addition, for redundancy, the fuze can include an additional capacitor, detonator, and energy source.

It is a particular feature of the invention that initiation of the fuze detonator is provided under all possible combinations of percussion initiation, timed initiation, armed fuze, and unarmed fuze, as seen in FIG. 6. If the fuze is armed, percussion should cause impact switch 40 to cause electric resistor bridge 38 to initiate the detonator. If it does not, the timer will cause electric resistor bridge 39 to initiate the detonator. In both cases, the fuze and the submunition grenade charge will explode.

If the fuze is not armed, for some reason, percussion should cause the impact switch to cause electric resistor bridge 38 to initiate the detonator. If it does not, the timer will cause electric resistor bridge 39 to initiate the detonator. Thus, the invention effectively provides two self-neutralization options. In either case, the fuze will explode, without exploding the submunition grenade charge.

If the fuze did not operate and was not destroyed, the electrical energy is discharged by self-discharge of the capacitor. Then the dud is safe and not dangerous, even if armed, since it has no internal energy source for initiation, or any mechanical system, like a striker, which could initiate the detonator by tilting or by the enemy as a booby trap. Finally, if the capacitor does not charge, neither the fuze nor the submunition grenade will explode. It will be appreciated that, in all these cases of duds, since there is no internal energy source and no mechanical initiation means, the dud is not dangerous for friendly forces and civilians.

It is a particular feature of the present invention that the system and method provide a number of advantages over conventional submunition fuzes. First is the prevention of undesirable actuation of fuzes due to collisions in air by submunition grenades, i.e., immediately after their expulsion. Second, the efficiency of the submunition grenade for an anti-tank target is increased by its initiation a very short time after impact (S.Q.). This increases the effectiveness of the hollow charge and prevents mechanical damage to the fuze and the submunition grenade components by the impact.

Third, the effectiveness of the submunition grenade is increased by the system for bouncing the submunition grenade into the air with a delayed initiation of the submunition grenade so that it explodes in the air and has a stronger anti-personnel effect. In other words, the self-destruct mechanism of the submunition grenade can be actuated at different times after impact on the ground.

Fourth, the probability of a dud is lowered by using the primary mode of operation (impact) as a self-neutralization mode of the detonator in the case that the fuze was not armed, as a redundancy to the timed self-destruct and self-neutralization activating modes.

Fifth, the number of dangerous duds is lowered substantially by means of the dual self-destruct and self-neutralization systems, as well as by avoidance of the use of a mechanical firing pin, sensitive to handling as a dud. It also prevents the use of duds as booby traps by the enemy. Sixth, the present invention lowers the cost of reclaiming the area for civilian use after a war, by lowering the number of duds.

Finally, the invention lowers the environmental pollution by avoiding the use of batteries in each submunition grenade's fuzes, and thereby not releasing any harmful materials. In particular, when a single, central battery in the projectile is used, the battery remains whole so no chemicals at all are released, while the submunition grenade has a completely electronic fuze without any internal energy source.

It will be appreciated that the invention is not limited to what has been described hereinabove merely by way of example. Rather, the invention is limited solely by the claims which follow.

What is claimed is:

1. A fuze for a submunition grenade comprising:

(a) an electric detonator;

(b) primary super quick apparatus for electrically initiating said electric detonator upon percussion; and (c) self-destruct apparatus for electrically initiating said electric detonator, after a period of time, when said primary apparatus fails to initiate said electric detonator, regardless of whether said fuze is armed or said fuze is not armed, wherein said primary super quick apparatus acts as a primary self-destruct apparatus to initiate said electric detonator without initiating a main charge, and said self-destruct apparatus acts as a secondary self-destruct apparatus to initiate said electric detonator without initiating said main charge.

2. The fuze according to claim 1, wherein said primary apparatus includes:

an integrated circuit;

an impact switch coupled to said integrated circuit; and an electric resistor bridge coupled to said electric detonator and to said integrated circuit for initiating said electric detonator in response to activation of said impact switch.

3. The fuze according to claim 1, wherein said self-destruct apparatus includes:

a timer; and an integrated circuit for initiating the electric detonator after passage of a predetermined time, in response to an output signal from said timer.

4. The fuze according to claim 1, further comprising an external energy source for charging an internal capacitor.

5. The fuze according to claim 4, wherein said external energy source is a thermal battery.

6. An electronic percussion fuze with electronic self-destruct apparatus for submunition grenades comprising:

a fuze housing;

an electrical conductor between an external energy source and the electronic fuze;

an electric detonator;

primary electrical apparatus for the super quick initiation of the fuze upon impact, including a micromachine accelerometer, integrated circuit, and electric resistor bridge to the electric detonator; and an electrical self-destruct apparatus for initiation of the fuze after a predetermined delay time, including a second electric resistor bridge to said electric detonator, and said integrated circuit, said electrical self-destruct apparatus being operative both when the fuze is armed and when the fuze is not armed.

7. A method of initiating a submunition grenade having a fuze and an electric detonator, the submunition grenade being arranged to be ejected from a projectile, the method including the steps of:

releasing the submunition grenade from the projectile;

electronically counting an inhibition time;

electrically initiating an electric detonator by a primary initiator upon percussion if the primary initiation does not cause the detonator to explode, electronically counting time to self-destruct; and electrically initiating the electric detonator by means of a self-destruct initiator whether or not the fuze is armed;

wherein when said fuze is not armed, said fuze is initiated upon percussion by said primary initiator in a self-neutralization mode.

8. The method of claim 7, further comprising the steps of:

firing the projectile; and charging a capacitor in the fuze from a battery in the projectile;

before said step of releasing.

9. The method of claim 7, further comprising the step of arming the submunition grenade fuze at the time of said step of counting an inhibition time.

10. The method of claim 7, wherein said fuze is not armed, and said fuze is initiated after a time delay by self-destruct initiator in a self-neutralization mode.

11. The method of claim 7, further comprising the step of bouncing the submunition grenade in the air and initiating the detenator by said primary initiator after a short delay, before said of initiating the said detonator by said self-destruct initiator.

12. The method of claim 7, further including the step of self-neutralization of the capacitor's stored energy if said detonator is not initiated.

13. A fuze for a submunition grenade comprising:

(a) an electric detonator;

(b) primary super quick apparatus for electrically initiating said electric detonator upon percussion;

(c) self-destruct apparatus for electrically initiating said electric detonator, after a period of time, when said primary apparatus fails to initiate said electric detonator, regardless of whether said fuze is armed or said fuze is not armed;

(d) wherein said primary apparatus and said self-destruct apparatus are formed as a single unit by micromachining.

14. An electronic percussion fuze with electronic self-destruct apparatus for submunition grenades comprising:

a fuze housing;

an electrical conductor between an external energy source and the electronic fuze;

an electric detonator;

primary electrical apparatus for the super quick initiation of the fuze upon impact, including a micromachine accelerometer, integrated circuit, and electric resistor bridge to the electric detonator; and electrical self-destruct apparatus for initiation of the fuze after a predetermined delay time, including a second electric resistor bridge to said electric detonator, and said integrated circuit.

* * * * *